US009470466B2

(12) United States Patent
Washburn, III et al.

(10) Patent No.: US 9,470,466 B2
(45) Date of Patent: Oct. 18, 2016

(54) MONOLITHIC NOISE SUPPRESSION DEVICE FOR FIREARM

(71) Applicant: Centre Firearms Co., Inc., Ridgewood, NY (US)

(72) Inventors: Richard Ryder Washburn, III, Brooklyn, NY (US); Richard Ryder Washburn, II, New York, NY (US)

(73) Assignee: CENTRE FIREARMS CO., INC., New York, NY (US)

( * ) Notice: Subject to any disclaimer, the term of this patent is extended or adjusted under 35 U.S.C. 154(b) by 0 days.

(21) Appl. No.: 13/840,371

(22) Filed: Mar. 15, 2013

(65) Prior Publication Data

US 2014/0262605 A1 Sep. 18, 2014

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/325; F41A 21/34; F41A 21/36; F41A 21/28; F41A 21/40
USPC ..... 89/14.4, 14.2, 14.3; 42/79; 181/223
See application file for complete search history.

(56) References Cited

U.S. PATENT DOCUMENTS 1,081,348 A * 12/1913 Unke ..... 181/264
3,677,132 A 7/1972 Plenge
4,291,610 A * 9/1981 Waiser ..... 89/14.4
4,576,083 A * 3/1986 Seberger, Jr. ..... 89/14.4
4,588,043 A * 5/1986 Finn ..... 181/223
4,974,489 A * 12/1990 Fishbaugh ..... 89/14.4
5,029,512 A * 7/1991 Latka ..... 89/14.4
5,136,923 A * 8/1992 Walsh, Jr. ..... 89/14.2
5,164,535 A 11/1992 Leasure
5,174,943 A 12/1992 Hull
6,308,609 B1 * 10/2001 Davies ..... 89/14.4
6,374,718 B1 * 4/2002 Rescigno et al. ..... 89/14.4
6,575,074 B1 * 6/2003 Gaddini ..... 89/14.4
6,796,214 B2 * 9/2004 Hausken et al. ..... 89/14.4
7,207,258 B1 4/2007 Scanlon
7,237,467 B1 * 7/2007 Melton ..... 89/14.4

(Continued)

OTHER PUBLICATIONS

Keith Lee, 1st Amendment+2nd Amendment=The Right to Print Arms, Sep. 20, 2011, pp. 1-7.*

(Continued)

*Primary Examiner* — Benjamin P Lee
(74) *Attorney, Agent, or Firm* — Keating & Bennett, LLP

(57) ABSTRACT

A monolithic noise suppression device comprising a monolithic, integral baffle housing module. The module comprising, in turn, at least no welded joints or seams between the various components that make up the core of the module and no welded joints or seams between the core, or any structures that make up the core, and the various interior surfaces and/or structures that make up the body of the module. The module is preferably plastic and manufactured using a layered printing process. The monolithic, integral baffle housing module may include various other features that enhance performance, reduce manufacturing cost, facilitate customization and eliminate restrictions on disposability as compared to conventional noise suppression devices. The monolithic noise suppression device may further comprise a first stage noise suppression device to be used in conjunction with the monolithic, integral baffle housing module.

21 Claims, 9 Drawing Sheets

(56) References Cited

U.S. PATENT DOCUMENTS

| | | | | |
|---|---|---|---|---|
| 7,308,967 | B1 * | 12/2007 | Hoel | 181/223 |
| 7,832,323 | B1 * | 11/2010 | Davies | 89/14.4 |
| 7,931,118 | B1 * | 4/2011 | Cronhelm | 181/223 |
| 8,112,931 | B2 * | 2/2012 | Yost et al. | 42/79 |
| 8,479,878 | B2 * | 7/2013 | Schlosser | 181/223 |
| 8,511,425 | B2 * | 8/2013 | Larue | 181/223 |
| 8,579,075 | B2 * | 11/2013 | Brittingham et al. | 181/223 |
| 2011/0220434 | A1 * | 9/2011 | Silvers | 181/223 |
| 2011/0297477 | A1 | 12/2011 | Koumbis | |
| 2012/0011757 | A1 * | 1/2012 | Yost et al. | 42/79 |
| 2012/0080261 | A1 | 4/2012 | Shand | |
| 2012/0145478 | A1 * | 6/2012 | Brittingham | 181/223 |
| 2012/0152649 | A1 * | 6/2012 | Larue | 181/223 |
| 2012/0180624 | A1 * | 7/2012 | Troy et al. | 89/14.4 |
| 2012/0272818 | A1 * | 11/2012 | Dueck et al. | 89/14.4 |
| 2013/0180797 | A1 * | 7/2013 | Dueck | 181/223 |
| 2013/0233162 | A1 * | 9/2013 | Schneider | 89/14.3 |
| 2013/0312592 | A1 * | 11/2013 | Storrs et al. | 89/14.1 |
| 2014/0020976 | A1 * | 1/2014 | Shults | 181/223 |

OTHER PUBLICATIONS

Al Paulson, Suppressed Ruger MK11 .22LR, Guns & Weapons fro Law Enforcement, May 2001, pp. 54-56 and 76.*

* cited by examiner

MONOLITHIC NOISE SUPPRESSION DEVICE FOR FIREARM

FIELD OF THE INVENTION

The present invention relates to noise suppression devices, and more particularly, noise suppression devices that are used with firearms.

BACKGROUND

Noise associated with the use of a firearm is, in general, attributed to two factors. The first factor is associated with the velocity of the bullet. If the bullet is traveling hypersonically (i.e., faster than the speed of sound), the bullet will pass through the slower moving sound wave preceding it, thus creating a relatively small sonic boom, similar to the sonic boom of a supersonic aircraft passing through its sound wave. The second factor is associated with the rapid expansion of propellant gas produced when the powder inside the bullet cartridge ignites. When the propellant gas rapidly expands and collides with cooler air, in and around the muzzle of the firearm, a loud bang sound occurs. Firearm noise suppression devices (hereafter "noise suppression devices") are employed to reduce noise attributable to the second factor identified above. Noise suppression devices have been in use at least since the late nineteenth century.

FIG. 1 is a cross-sectional view of a contemporary noise suppression device 100. As illustrated, noise suppression device 100 includes an inner structure or core 105 and an outer structure 110. Typically, the core 105 and the outer structure 110 are manufactured independent of each other. Subsequently, the core 105 is inserted in and secured to the outer structure 110. Securing the inner structure 105 to the outer structure 110 may be achieved by welding (e.g., spot welding) the former to the latter. Together, the core 105 and outer structure 110 are often referred to as a "can."

The core 105, in turn, comprises a plurality of linearly arranged segments that together form a plurality of compartments 105*a* through 105*f*, wherein adjacent compartments are separated by a corresponding baffle 115*a* through 115*e*. It is very common to manufacture each segment separately and then attach the segments together, e.g., by welding the segments, to form the aforementioned linear arrangement, as suggested by the weld joints or seams that appear between each of the segments in FIG. 1 (see e.g., seams 120*a*, 120*b*, 120*c*, 120*d* and 120*e*). Although it may be common to manufacture each of the aforementioned segments separately and then subsequently attach them together, it is also known to manufacture the segments as a single, integral unit. Such a unit is referred to as a monolithic core. The monolithic core is then inserted in and secured to the outer structure 110, as previously described.

Additionally, the distal end of the core 105 comprises an end cap segment 125, while the proximal end of the core 105 comprises a base cap segment 130. As illustrated, there is an opening formed through each of the baffles 115*a* through 115*e*, the end cap structure 125 and the base cap structure 130, along a longitudinal centerline Y, which defines the path through the noise suppression device 100 traveled by each fired bullet.

Although it is not shown in FIG. 1, the proximal end of the noise suppression device 100 would comprise an attachment structure. The attachment structure would be configured to attach the noise suppression device 100 to a complimentary structure associated with the muzzle of the firearm.

As mentioned above, noise suppression devices reduce the noise associated with the rapid expansion of propellant gas when the powder inside the bullet cartridge ignites and the propellant gas subsequently collides with cooler air in and around the muzzle of the firearm. In general, noise suppression devices reduce the noise by slowing the propellant gas, thus allowing the propellant gas to expand more gradually and cool before it collides with the air in and around the muzzle of the firearm.

Thus, with respect to the noise suppression device 100 in FIG. 1, the bullet will first pass from the muzzle of the firearm into the first expansion chamber 135. It should be noted that this first chamber is often called a blast chamber or blast baffle. The first expansion chamber 135 allows the propellant gas to expand and cool, thereby reducing the amount of energy associated with the gas. The bullet then successively passes through the openings in each of the baffles 115*a* through 115*e*, wherein the baffles further deflect, divert and slow the propellant gas. By the time the bullet and gas exit the opening through the end cap structure 125 at the distal end of the noise suppression device 100, the gas has already substantially slowed, expanded and cooled, thus reducing the noise associated with the gas colliding with the cooler air in and around the distal end of the noise suppression device 100.

Conventional noise suppression devices are typically constructed from steel, aluminum, titanium or other metals or metal alloys. Metals generally have good thermal conductivity characteristics. Therefore, metal noise suppression devices can better absorb the heat that is produced by the rapidly expanding propellant gas. This ability to better absorb the heat helps to more quickly cool the propellant gas, thereby reducing both the temperature and volume of the gas, and in turn, the resulting noise when the gas collides with the ambient air.

Despite the fact that noise suppression devices have been in use for well over 100 years, and numerous improvements have been made over this time period, there are still many disadvantages associated with conventional noise suppression devices. For example, the noise suppression device 100 described and illustrated above inherently has reliability issues in that each welding joint or seam increases the probability of structural failure due to the high levels of pressure associated with the propellant gas inside the device.

The use of metal also leads to certain disadvantages. Metal is costly and manufacturing a noise suppression device, such as noise suppression device 100, is somewhat complex. Consequently, manufacturers may be discouraged to make and customers may be reluctant to purchase customized noise suppression devices, as customized noise suppression devices are likely to be even more costly and more complex to manufacture. An example of a customized noise suppression device may be one that is designed and constructed to operate in conjunction with, or at least not interfere with a particular gun sight.

Further with regard to the use of metal, the aforementioned thermal conductivity may actually be undesirable in certain situations. For instance, after firing the weapon, the noise suppression device may be very hot due to the fact that the metal is efficient at absorbing the heat associated with the propellant gas. This is particularly true if the weapon is fired repeatedly. And, if the noise suppression device is hot, it may be very difficult for the user to remove it from the weapon until it cools. This may be unacceptable if the user needs to quickly replace the noise suppression device for another. In a military environment, a hot noise suppression device may also be highly visible to enemy combatants using infrared technology, thus exposing the user to greater risk.

Yet another disadvantage associated with metal noise suppression devices is that these noise suppression devices are considered weapons in and of themselves, separate and apart from the firearm to which they may be attached. Thus, they are regulated under the National Firearms Act (1934) (NFA). As such, these devices must be separately marked and registered, and they cannot simply be discarded when they are worn or otherwise fail to function adequately. This is true, even if the devices are being used in a war zone or military environment.

Therefore, despite the many improvements that have been effectuated over the decades, additional design features and manufacturing techniques are warranted to improve the reliability, enhance the noise reduction, reduce the costs, facilitate customization and eliminate the restriction on disposability of conventional noise suppression devices. The present invention offers a number of improvements that address these concerns.

SUMMARY OF THE INVENTION

The present invention achieves its intended purpose through design features and manufacturing techniques that both individually and in conjunction with each other offer improvements over current, state-of-the-art noise suppression devices. More particularly, the present invention involves a truly monolithic noise suppression device, referred to herein below as an integral baffle housing module. Unlike the noise suppression device 100 illustrated in FIG. 1, the integral baffle housing module, in accordance with exemplary embodiments of the present invention, at least exhibits no welded joints or seams associated with the core nor any welded joints or seams between the core and any interior surface and/or structure.

Preferably, the integral baffle housing module is manufactured from plastic using a layered printing process. Because the integral baffle housing module is truly monolithic and preferably plastic, it achieves better overall performance and is more easily customizable, all at a lower cost than conventional noise suppression devices.

In addition, it is preferable that the integral baffle housing module be used in conjunction with a first stage noise suppression device, where the first stage noise suppression device attaches to the firearm and the integral baffle housing module attaches to the first stage noise suppression device. By employing the integral baffle housing module with the first stage noise suppression device, and because the integral baffle housing module is preferably made of plastic, the integral baffle housing module is more likely to be considered a disposable asset, whereas the first stage noise suppression device will constitute the suppressor that must be marked and registered under the NFA.

Still further, the integral baffle housing module may include a number of additional design features including rounded or filleted portions where certain internal surfaces come together, a plurality of baffles having one or more bleed holes formed therethrough, and one or more textured or patterned interior surfaces. Other features and/or techniques will be evident from the detailed disclosure that follows.

In accordance with one aspect of the present invention, the intended and other purposes are achieved with a monolithic noise suppression device for use with a firearm. The monolithic noise suppression device includes a body, a plurality of internal chambers and one or more baffles. Each of the one or more baffles is seamlessly connected to the body.

In accordance with another aspect of the present invention, the intended and other purposes are achieved with a noise suppression assembly for use with a firearm. The assembly comprises a first stage noise suppression device attached to the firearm and a monolithic, integral baffle housing module attached to said first stage noise suppression device. The monolithic, integral baffle housing module comprises, in turn, a body; a plurality of internal chambers; and a core comprising one or more baffles, wherein the core is seamlessly connected to the body.

BRIEF DESCRIPTION OF THE DRAWINGS

Several figures are provided herein to further the explanation of the present invention. More specifically.

DETAILED DESCRIPTION OF THE INVENTION

It is to be understood that both the foregoing general description and the following detailed description are exemplary. The descriptions herein are not intended to limit the scope of the present invention. The scope of the present invention is governed by the scope of the appended claims.

The noise suppression device, in accordance with exemplary embodiments of the present invention, is a truly monolithic device which is referred to herein as an integral baffle housing module. As previously stated, it is preferably made of plastic. Also, as previously stated, it is preferably employed with a first stage noise suppression device.

Figure 2:
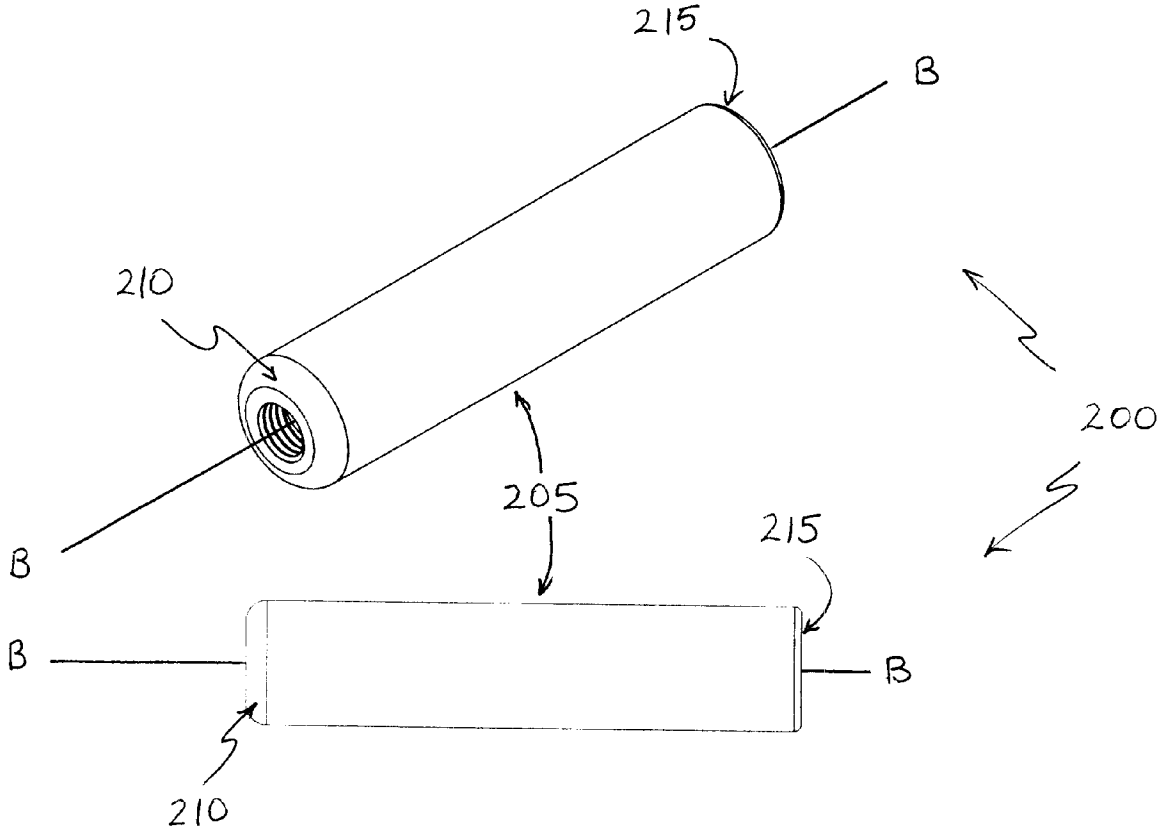
FIG. 2 is a side exterior view and a perspective exterior view of an integral baffle housing module, in accordance with a first exemplary embodiment of the present invention.

FIG. 2 illustrates a side exterior view and a perspective exterior view of an integral baffle housing module 200, in accordance with an exemplary embodiment of the present invention. As illustrated, the integral baffle housing module 200 comprises a generally cylindrical body 205; however, the present invention is not limited by nor is the function affected by the shape of the body 205. Additionally, the body 205 comprises an integral, proximal end cap 210 and an integral, distal end cap 215.

Figure 3:
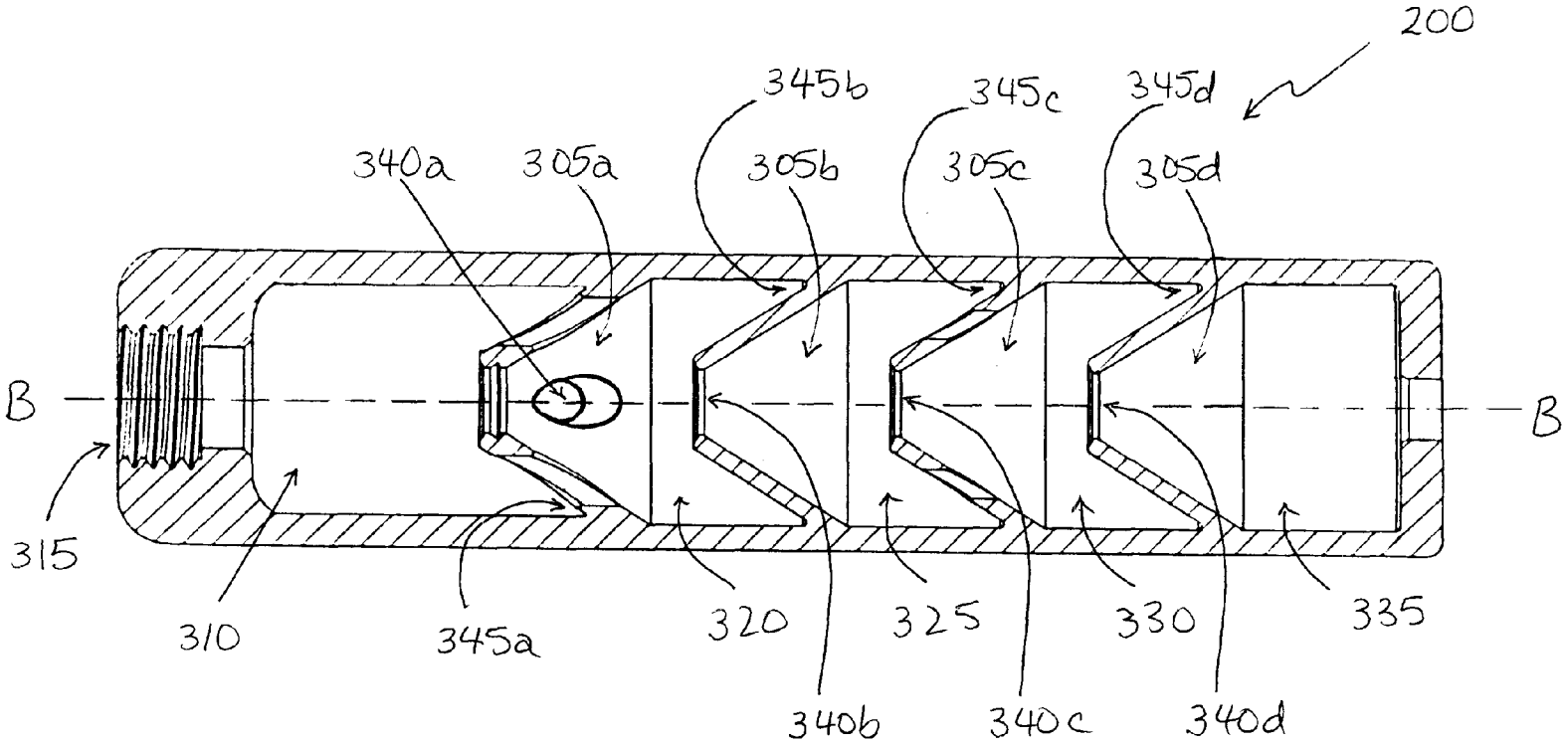
FIG. 3 is a longitudinal section view of the integral baffle housing module, in accordance with the first exemplary embodiment.

FIG. 3 illustrates a longitudinal section view of the integral baffle housing module 200, in accordance with a first exemplary embodiment of the integral baffle housing module 200. As illustrated, the integral baffle housing module 200 comprises a plurality of baffles 305*a*, 305*b*, 305*c* and 305*d*, which constitute all or a part of the core of the integral baffle housing module 200. It is common to refer to the plurality of baffles as a baffle stack. It will be understood, however, that the present invention is not limited to a device having a specific number of baffles. Thus, the integral baffle housing module 200 could comprise one baffle or more than one baffle (i.e., a plurality of baffles).

The integral baffle housing module 200, according to the first exemplary embodiment, further comprises a number of interior chambers. These chambers include a first expansion chamber 310. As stated previously, this first chamber is often referred to as a blast chamber or blast baffle. The first expansion chamber 310 is generally located between baffle 305*a* and proximal end cap 210. The chambers also include chambers 320, 325, 330 and 335, where chamber 320 is generally located between baffles 305*a* and 305*b*, chamber 325 is generally located between baffles 305*b* and 305*c*, chamber 330 is generally located between baffles 305*c* and 305*d*, and chamber 335 is generally located between baffle 305*d* and distal end cap 215.

Further in accordance with the first exemplary embodiment of the integral baffle housing module 200, as illustrated in FIG. 3, each of the baffles 305*a*, 305*b*, 305*c* and 305*d* may be structurally identical. However, in FIG. 3, baffle 305*a* is shown in more complete form than are baffles 305*b*, 305*c* and 305*d* in order to better illustrate the fact that each of the baffles 305*a*, 305*b*, 305*c* and 305*d* has formed therethrough an opening 340*a*, 340*b*, 340*c* and 340*d*, respectively. It should be evident that the openings 340*a*, 340*b*, 340*c* and 340*d* are centered on longitudinal axis B and that the path of a fired bullet follows longitudinal axis B through each of these openings.

Also, as illustrated in FIG. 3, the integral baffle housing module 200 comprises an attachment mechanism, such as female threads 315. As previously stated, it is preferable that the integral baffle housing module 200 be used in conjunction with a first stage noise suppression device, described in detail below, where the first stage noise suppression device is configured to attach directly to the firearm, and the integral baffle housing module 200 is configured to attach to the first stage noise suppression device. The female threads 315 represent an exemplary attachment mechanism that is configured to attach the integral baffle housing module 200 to a complimentary attachment mechanism associated with the first stage noise suppression device. Those skilled in the art will appreciate the fact that other attachment mechanism configurations are within the scope of the present invention. If the integral baffle housing module 200 is not used in conjunction with a first stage noise suppression device, the attachment mechanism, such as the female threads 315 would be used to attach the integral baffle housing module 200 directly to the muzzle of the firearm.

In accordance with the present invention, the integral baffle housing module 200 is manufactured as a monolithic unit. In accordance with a preferred embodiment, the integral baffle housing module 200 is made from plastic and manufactured using a layered printing process. Layered printing is a well known process for manufacturing three-dimensional objects from a digital model, whereby micro-thin layers of the manufacturing material are laid down successively until the entire three-dimensional object is complete.

As referred to herein below, an integral baffle housing module is monolithic if there are at least no welded joints or seams between the various components that make up the core of the integral baffle housing module (e.g., the one or more baffles), and no welded joints or seams between the core, or any structures that make up the core, and the various interior surfaces and/or structures that make up the body of the integral baffle housing module 200. For example, comparing the longitudinal view of integral baffle housing module 200 in FIG. 3 to the conventional noise suppression device 100 in FIG. 1, it can be seen that no welded joints or seams, such as seams 120*a*, 120*b*, 120*c*, 120*d* and 120*e*, exist in the integral baffle housing module 200. As stated, this can be accomplished using a layered printing process.

It should be noted, however, the present invention does not necessarily exclude the addition of other structural components that are not integral, so long as there are at least no welded joints or seams between the various components that make up the core of the integral baffle housing module (e.g., the one or more baffles), and no welded joints or seams between the core, or any structures that make up the core, and the various interior surfaces and/or structures that make up the body of the integral baffle housing module 200, as stated above. For example, in the first exemplary embodiment of FIGS. 2 and 3, the proximal and distal end caps 210 and 215 are illustrated as being integral components of the integral baffle housing module 200. That is, there are no welded joints or seams between the end caps and the body of the integral baffle housing module 200. However, in accordance with exemplary embodiments of the present invention, the integral baffle housing module is still considered monolithic even if the end caps are not integral, so long as the other aforementioned requirements are met.

Figure 1:
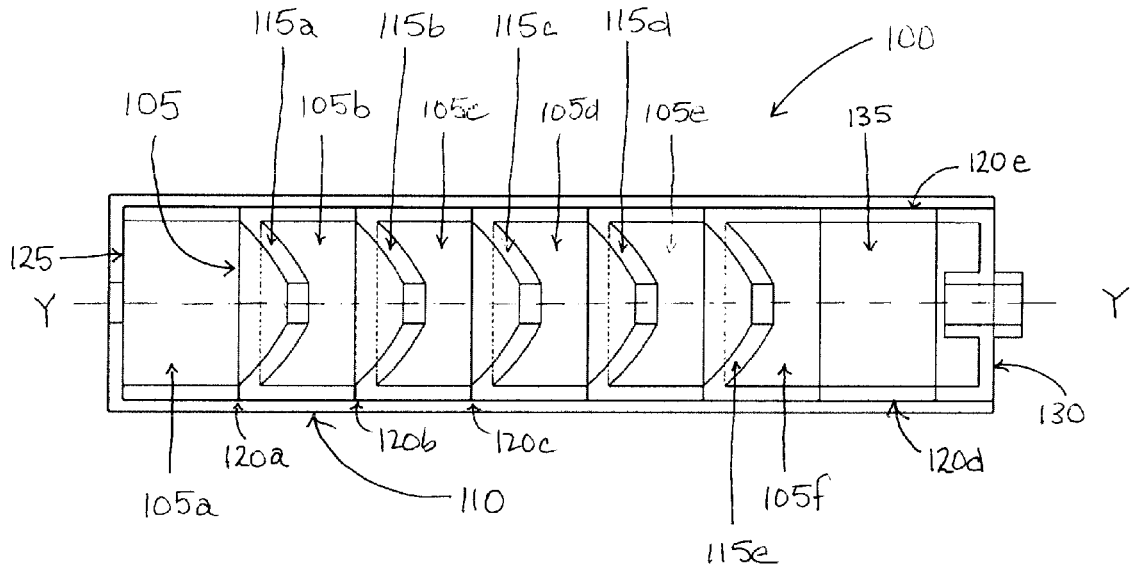
FIG. 1 (RELATED ART)
FIG. 1 is a cross-sectional view of a contemporary noise suppression device.

As one skilled in the art will readily appreciate, the propellant gas exerts a great deal of pressure on the inner surfaces of any noise suppression device, and the welded joints or seams, such as seams 120*a*, 120*b*, 120*c*, 120*d* and 120*e* illustrated in the conventional noise suppression device 100 of FIG. 1, are more likely to serve as points of mechanical failure than the corresponding, seamless points in integral baffle housing module 200. Thus, as stated above, manufacturing the integral baffle housing module 200 as a monolithic unit will enhance the structural integrity of the device.

While the present invention is not limited to a integral baffle housing module made of plastic, the use of plastic results in several unexpected benefits. First, plastic is relatively porous in comparison to metal. Experimental tests suggest that this porosity provides an alternative pathway for the expanding propellant gas to escape the suppressor. Furthermore, as a result of the layered printing process, there are actually very small layers of air between each of the layers of plastic material. The testing also suggests that the expanding propellant gas is able to escape through these layers of air. Although the amount of propellant gas that actually escapes through these alternative pathways is relatively small, it is enough to realize a measurable improvement in noise reduction as a result.

Second, materials such as metal, that exhibit good heat absorption (i.e., good heat transfer characteristics), generally make good noise suppression devices because they have the ability to remove heat from the expanding propellant gas, thus lowering the temperature of the gas and improving noise suppression. While plastic does not absorb heat as well as metal, the aforementioned porosity of plastic is still effective in removing heat from the propellant gas because the porosity allows the heat, along with the propellant gas, to vent from the inside to the outside of the integral baffle housing module.

Further, because plastic does not absorb heat as does metal, the temperature of the plastic will stay relatively cool, compared to metal, despite the excessive heat produced by the propellant gas. Thus, if the user wants to remove the integral baffle housing module, the user will be able to do so soon, if not immediately after firing the weapon. In contrast, a user will need to wait a longer period of time to remove a metal noise suppression device, absent the use of well insulted gloves or some other insulated material to protect the user's hands from burning. The ability to immediately remove the integral baffle housing module may be a great advantage, particularly if the user needs to quickly swap the integral baffle housing module for another and resume firing.

Still further, another unexpected benefit is that a plastic integral baffle housing module suppressor will have a significantly lower heat signature compared to a metal noise suppression device. This benefit may be particularly advantageous in military environments in that the plastic integral baffle housing module will be less visible to enemy combatants using infrared sensors, which are commonly employed in night-vision equipment.

Also, plastic is generally less expensive than metal. Thus, it is generally less expensive to manufacture suppressors made of plastic. Because it is less expensive to manufacture a plastic suppressor, it is more practical to customize suppressors to meet very specific mission requirements. For example, if there is a specific need to manufacture a noise suppression device that can be used in conjunction with a particular firearm and, possibly, a very specific gun sight, then plastic may be more practical than metal.

Further in accordance with the first exemplary embodiment, integral baffle housing module 200 comprises several rounded or filleted portions 345*a*, 345*b*, 345*c* and 345*d*. These portions coincide with the intersection between certain interior surfaces. Preferably, these rounded or filleted portions generally face towards the proximal end of the integral baffle housing module 200, in a direction that is generally opposite the flow of the propellant gas. When the propellant gas strikes these rounded or filleted portions, the rounded or filleted portions exacerbate the turbulent flow of the propellant gas. As those skilled in the art understand, turbulent gas flow slows down the movement of the gas which, in turn, enhances noise suppression.

Figure 4A:
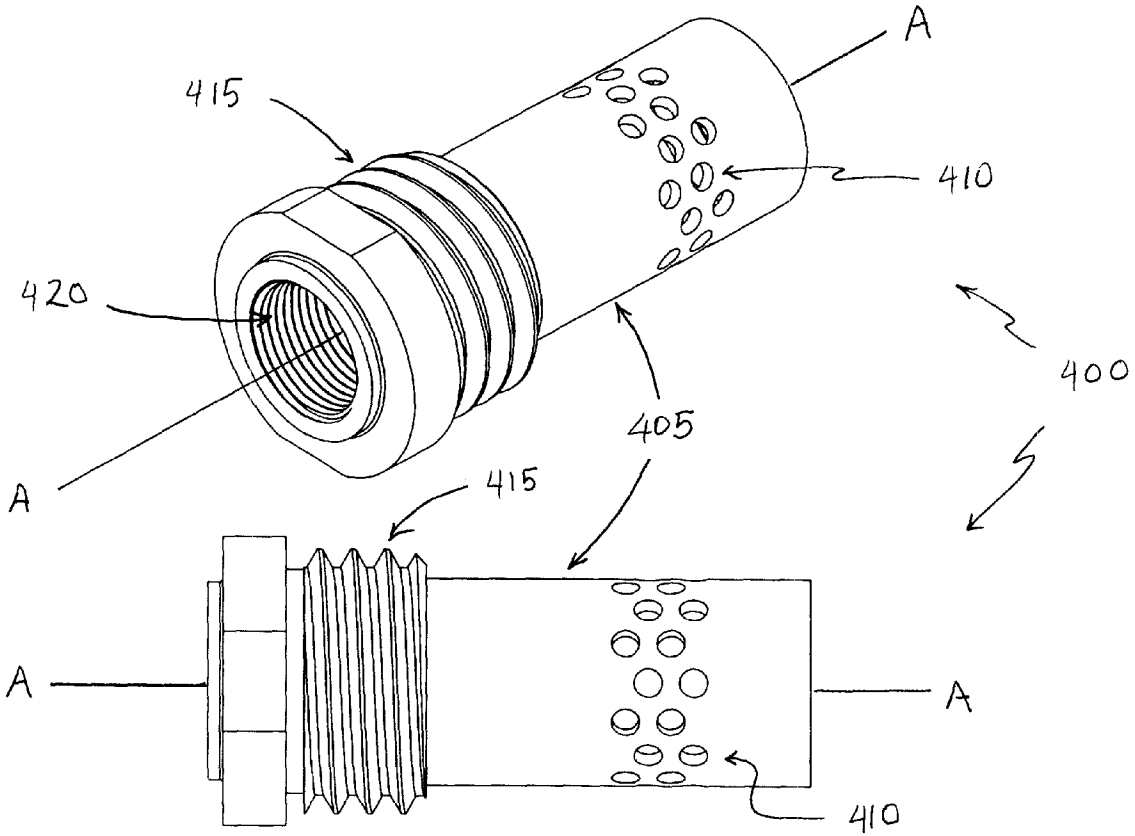
FIGS. 4A and 4B are side, perspective and longitudinal section views of a first stage noise suppression device, in accordance with an exemplary embodiment of the present invention.

As mentioned, it is preferable, though not required, that integral baffle housing module 200 be used in conjunction with a first stage noise suppression device. FIG. 4A illustrates a side view and a perspective view of an exemplary first stage noise suppression device 400, in accordance with an exemplary embodiment of the present invention. As illustrated, the first stage noise suppression device 400 comprises a generally cylindrical body 405. The body 405, in turn, comprises a plurality of openings 410. Additionally, the first stage noise suppression device 400 is preferably manufactured from an appropriate metal or metal alloy. However, it will be understood that the scope of the present invention is not a function of nor is it limited by the shape of the body 405, the shape, size or number of openings 410 there through, or the material that is used to manufacture the first stage noise suppression device 400.

The first stage noise suppression device 400 also comprises two threaded portions: a first threaded portion 415 and a second threaded portion 420. The first threaded portion 415 is illustrated as comprising male threads formed around the outside of the first stage noise suppression device 400. In accordance with this exemplary embodiment, the first threaded portion 415 is configured to communicate with the female threads 315 of integral baffle housing module 200 in order to physically attach the integral baffle housing module 200 and the first stage noise suppression device 400 to each other. When the first stage noise suppression device 400 and the integral baffle housing module 200 are physically attached, it will be understood that, in accordance with this exemplary embodiment, the body 405 of the first stage noise suppression device 400 extends through an opening in the proximal end cap 210 of the integral baffle housing module 200 and into the first expansion chamber 310, such that the longitudinal axis A associated with the first stage noise suppression device 400 aligns with the longitudinal axis B associated with the integral baffle housing module 200. The second threaded portion 420 of the first stage noise suppression device 400 is illustrated as comprising female threads formed on the interior of the secondary noise suppression module 400. In accordance with this exemplary embodiment, the second threaded portion 420 is configured to communicate with corresponding male threads on the barrel of the firearm in order to physically attach the first stage noise suppression device 400 to the firearm. Those skilled in the art will appreciate that structures other than the first threaded portion 415 and the second threaded portion 420 may be used to attach the first stage noise suppression device 400 to the integral baffle housing module 200 and the first stage noise suppression device 400 to the firearm, respectively.

Additionally, the first stage noise suppression device 400 is formed around a longitudinally extending opening or bore centered on longitudinal axis A. The first stage noise suppression device 400 is configured such that the bore aligns with the bore of the firearm barrel. As such, the bullet, after it travels through the bore of the firearm barrel, will travel through the bore of the first stage noise suppression device 400 and eventually into the integral baffle housing module 200.

Figure 4B:
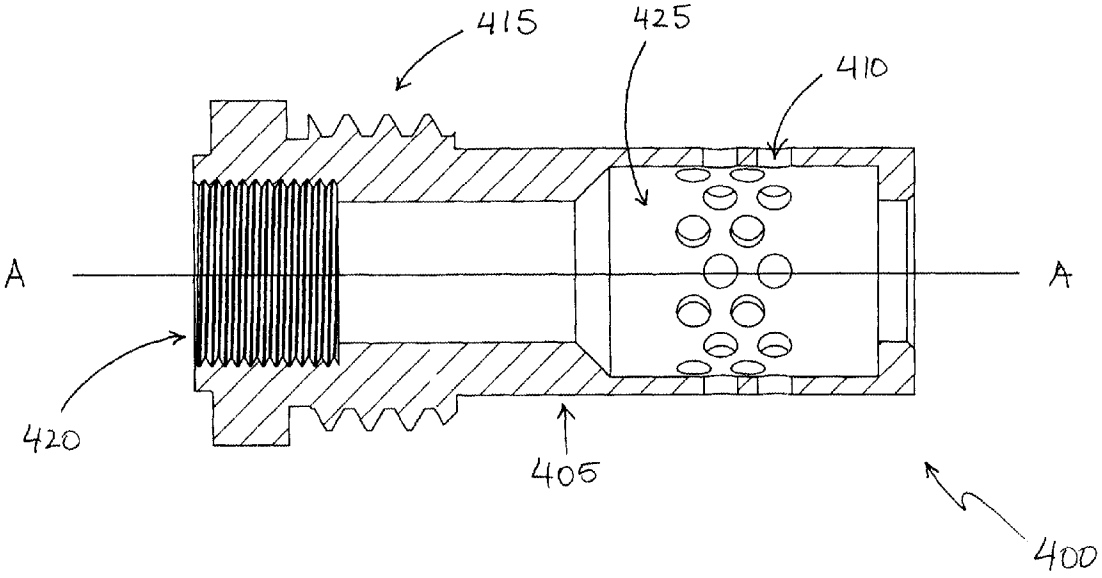

FIG. 4B is a longitudinal section view of the first stage noise suppression device 400. It will be understood from FIG. 4B that the first stage noise suppression device 400 is, in and of itself, a noise suppression device, separate and apart from the integral baffle housing module 200. In accordance with the exemplary embodiment of FIG. 4B, first stage noise suppression device 400 comprises an expansion or blast chamber 425, where the aforementioned openings 410 are formed there through. As the bullet travels through the bore of the first stage noise suppression device 400, the expansion chamber 425 and the openings 410 collectively allow the propellant gas to expand, cool and ultimately vent into the first expansion chamber 310 of the integral baffle housing module 200.

Figure 5:
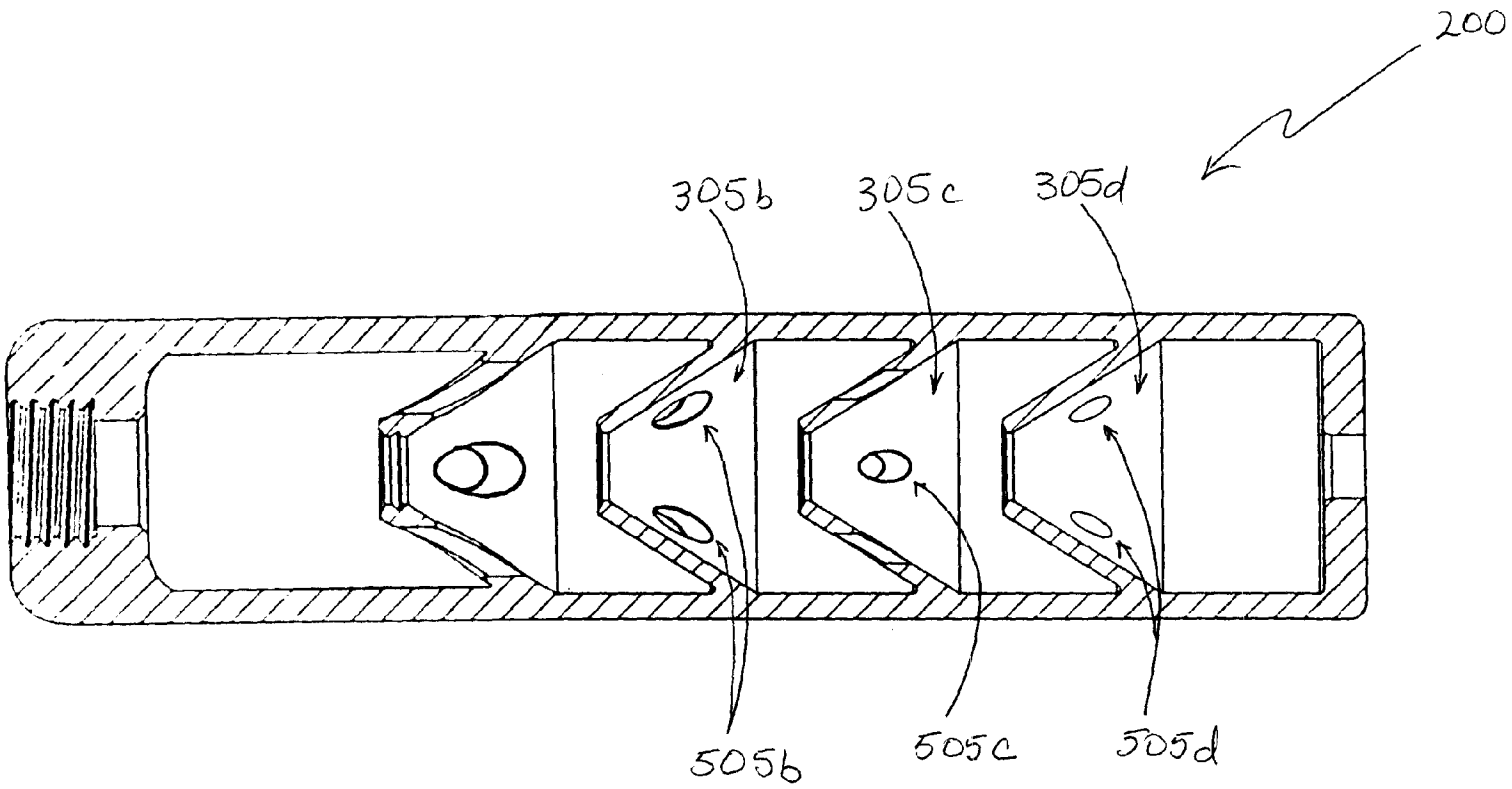
FIG. 5 is a longitudinal section view of the integral baffle housing module, in accordance with a second exemplary embodiment.

FIG. 5 illustrates a longitudinal section view of integral baffle housing module 200, in accordance with a second exemplary embodiment of the integral baffle housing module 200. As shown, the second exemplary embodiment appears similar to the first exemplary embodiment but for baffles 305*b*, 305*c* and 305*d* have bleed holes 505*b*, 505*c* and 505*d* formed there through. The bleed holes 505*b*, 505*c* and 505*d* allow the propellant gas to bleed into the next chamber. The bleed holes may be the same in terms of size and orientation; however, in a preferred embodiment, the size of the bleed holes is smaller towards the distal end of the integral baffle housing module 200 and the orientation of the bleed holes varies with respect to their position on or through the corresponding baffle. By varying the size and orientation of the bleed holes 505*b*, 505*c* and 505*d*, as shown, the force and pressure associated with the propellant gas is more evenly distributed within the integral baffle housing module 200, while helping to slow the movement of the propellant gas. As stated, slowing down the movement of the propellant gas enhances noise suppression.

It is known in the art to place ablative material inside conventional noise suppression devices. The ablative material is typically in the form of a gel or liquid. These conventional noise suppression devices are generally referred to as "wet" suppressors. The gel or liquid absorbs the heat from the propellant gas, thereby cooling the gas and reducing noise. However, keeping the ablative material inside the noise suppression device can be problematic. Thus, FIG. 6 illustrates a longitudinal section view of integral baffle housing module 200, in accordance with a third exemplary embodiment of the integral baffle housing module 200, wherein one or more interior surface(s) associated with the integral baffle housing module 200 are configured to better retain ablative material placed therein.

More specifically, at least the first expansion chamber 610 would contain ablative material, and to help retain or otherwise hold the ablative material in place, the interior surface of the first expansion chamber 610 is textured or patterned. In the exemplary embodiment illustrated in FIG. 6, a lattice-like structure 650 is employed. The lattice-like structure 650 would be particularly useful where the ablative material is a gel or otherwise viscous in nature. After injecting the ablative material into the first expansion chamber 610 and spinning the integral baffle housing module 200 so that the ablative material is evenly distributed within the first expansion chamber 610, the lattice-like structure 650 will serve to trap the ablative material, thereby holding the ablative material in place. It will be understood that ablative material could be similarly introduced into one or more of the other chambers in the integral baffle housing module 200 and that the interior surfaces of these chambers may likewise include a lattice-like structure or other effective textures or patterns.

Figure 7:
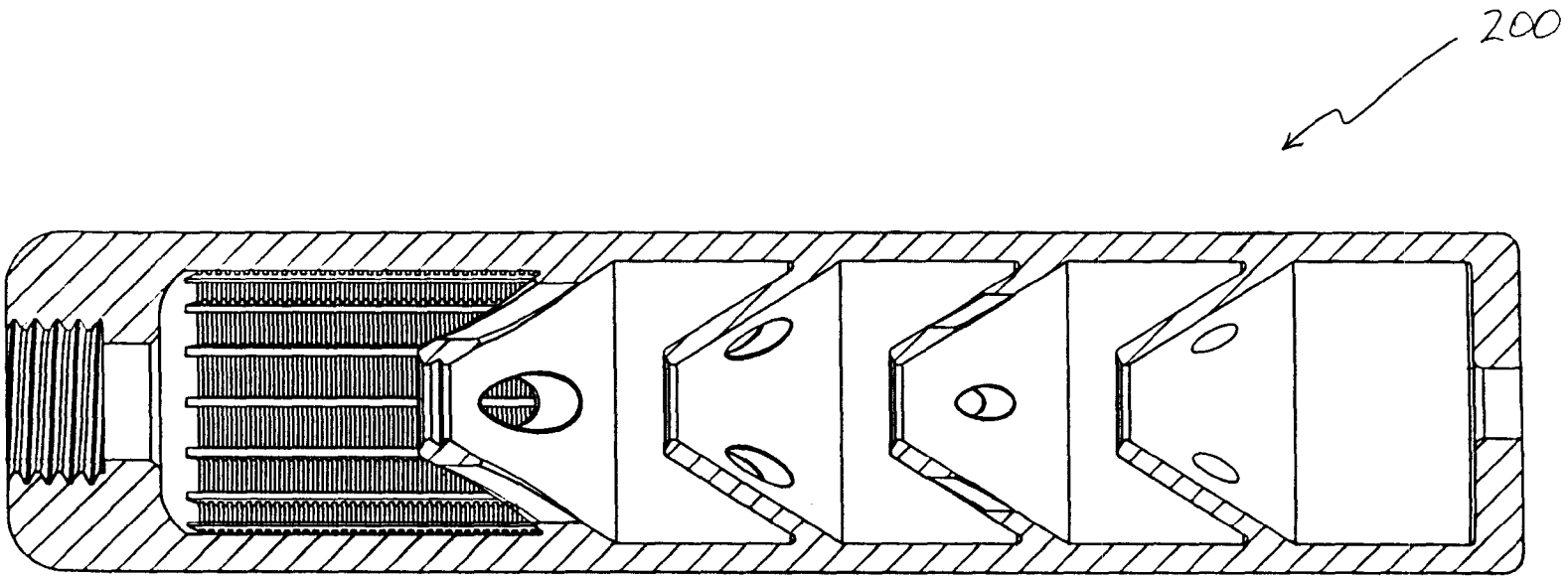
FIG. 7 is a longitudinal section view of the an integral baffle housing module, in accordance with a fourth exemplary embodiment.

FIG. 7 illustrates a longitudinal section view of the integral baffle housing module 200, in accordance with a fourth exemplary embodiment of the integral baffle housing module 200. The purpose of FIG. 7 is to show that two or more of the features associated with the integral baffle housing module 200 may be employed together in combination or separately as described above.

Figure 6:
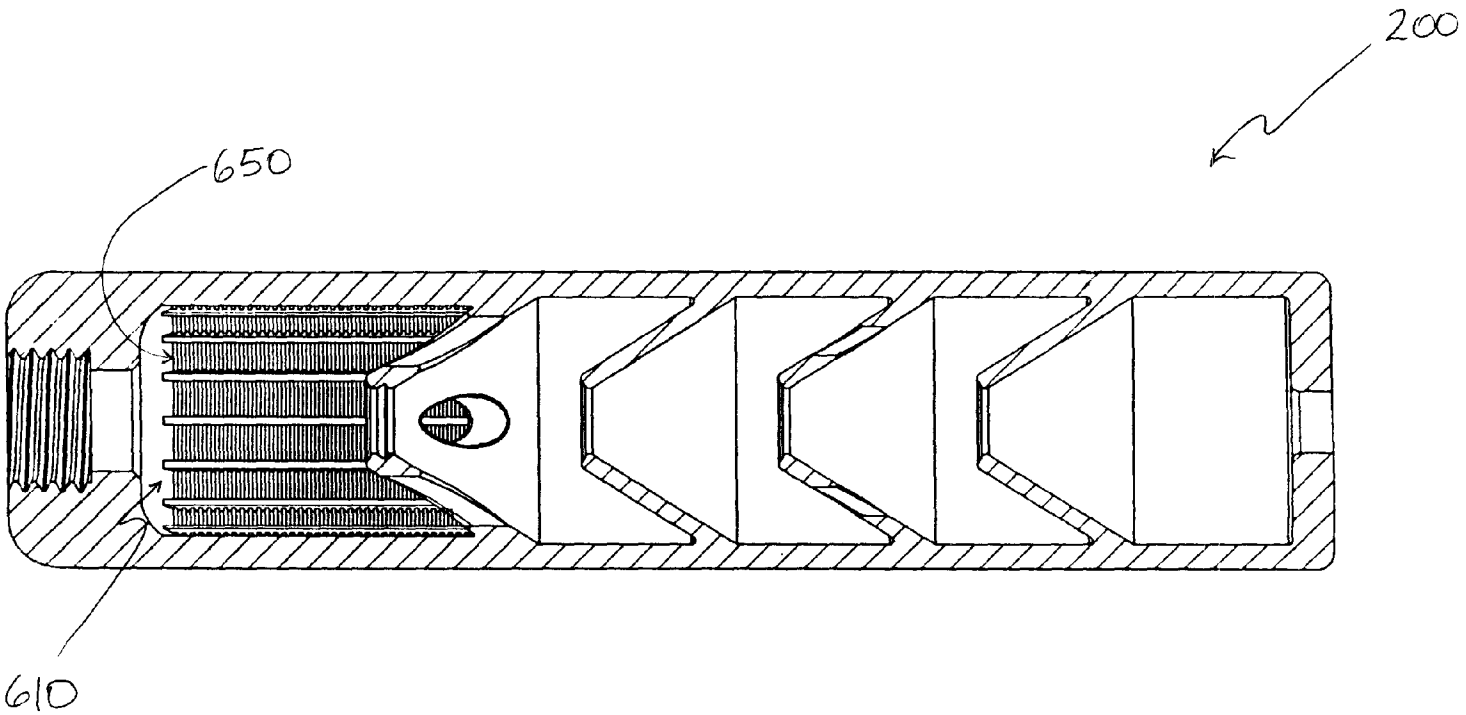
FIG. 6 is a longitudinal section view of the integral baffle housing module, in accordance with a third exemplary embodiment.
Figures 8A, 8B:
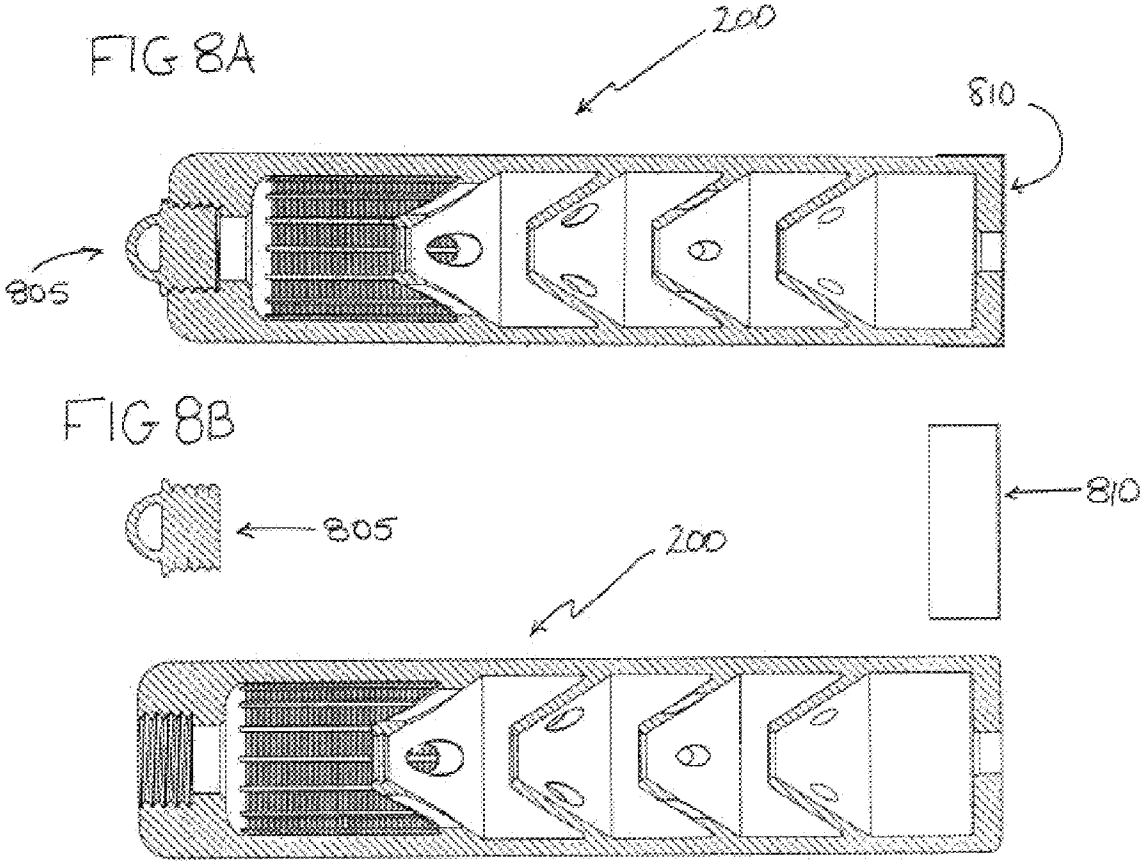
FIGS. 8A and 8B are longitudinal section views that illustrate exemplary components used to seal the openings through the proximal and distal end caps of an integral baffle housing module.

FIGS. 8A and 8B further illustrate that the third exemplary embodiment of FIG. 6 may be enhanced by closing off (i.e., sealing) the openings through the proximal and distal end caps of the integral baffle housing module 200. In FIGS. 8A and 8B, the components that are employed to seal the openings are plug 805, which closes off the opening in the proximal end of the integral baffle housing module 200, and seal 810, which closes off the opening in the distal end of the integral baffle housing module 200. By closing off the openings at both ends of the integral baffle housing module 200, it is possible to prevent the ablative material from being exposed to the air. When the integral baffle housing module 200 is first employed, the user would pull on plug 805, thereby removing it from the opening in the proximal end of the integral baffle housing module 200, attach the integral baffle housing module 200 to the first stage noise suppression device 400 (assuming the integral baffle housing module 200 is being used with the first stage noise suppression device 400) and then fire the first bullet, which pierces seal 810.

In accordance with an alternative embodiment relating to FIG. 6 and FIGS. 8A and 8B, if the ablative material introduced into integral baffle housing module 200 does not fill the entire interior space, it is possible to fill the remainder of that space with inert gas. The inert gas in conjunction with the ablative material will help prevent what is referred to in the art as "first round pop" because there is no oxygen in the integral baffle housing module 200.

In accordance with the exemplary embodiments of the present invention, as described above, the integral baffle housing module 200 is manufactured as a truly monolithic unit. Preferably, the monolithic integral baffle housing module 200 is made of plastic and manufactured using a layered printing process. Moreover, the integral baffle housing module 200 may comprise various other features, as detailed above, such as rounded or filleted portions, bleed holes and textured or patterned interior surfaces along with seals to help retain ablative material. These features enhance performance, reduce manufacturing cost and facilitate customization, as compared to conventional noise suppression devices, such as the noise suppression device illustrated in FIG. 1.

Additionally, the integral baffle housing module 200, according to exemplary embodiments of the present invention, may be used in conjunction with a first stage noise suppression device. If employed with a first stage noise suppression device, such as first stage noise suppression device 400 illustrated in FIG. 4, which attaches directly to the firearm, the first stage noise suppression device 400 may serve as the regulated noise suppression device under the NFA, whereas the integral baffle housing module 200 is deemed a mere accessory that need not be registered. As such, the integral baffle housing module 200 can be easily discarded or disposed of when it is worn or otherwise not functioning properly. Disposability is a major advantage, at least in terms of convenience, particularly when used for military operations and in combat zones, where it may be necessary to frequently change noise suppression devices because they are no longer functioning without having to carry around old, non-functioning devices.

The present invention has been described in terms of exemplary embodiments. It will be understood that the certain modifications and variations of the various features described above with respect to these exemplary embodiments are possible without departing from the spirit of the invention.

What is claimed is:

1. A monolithic noise suppression device for use with a firearm, said device comprising:

a body having an outermost external surface of the noise suppression device and an internal surface;

a plurality of internal chambers; and a core comprising one or more baffles having space between the baffles forming the plurality of internal chambers, seamlessly connected to the internal surface of the body, wherein the noise suppression device includes no joints, seams, or any formerly separate pieces within any of the body, the core, and the one or more baffles.

2. The monolithic noise suppression device of claim 1, wherein each of said one or more baffles has formed therethrough an opening centered on a longitudinal axis associated with said monolithic noise suppression device.

3. The monolithic noise suppression device of claim 2, wherein at least one of said one or more baffles has formed therethrough a bleed hole, in addition to the opening centered on the longitudinal axis.

4. The monolithic noise suppression device of claim 2 wherein the one or more baffles are linearly aligned.

5. The monolithic noise suppression device of claim 4, wherein the orientation of the one or more bleed holes associated with each of the plurality of baffles is offset relative to the one or more bleed holes associated with an adjacent baffle.

6. The monolithic noise suppression device of claim 4, wherein the size of the one or more bleed holes changes towards a distal end of said monolithic noise suppression device.

7. The monolithic noise suppression device of claim 1, wherein at least one internal surface associated with at least one of said one or more baffles intersects an internal surface associated with said body such that the point where the surfaces intersect is rounded or filleted.

8. The monolithic noise suppression device of claim 1, wherein at least one of said plurality of internal chambers contains ablative material, and wherein an internal surface associated with the at least one internal chamber is textured.

9. The monolithic noise suppression device of claim 8, wherein the texture is a lattice-like structure.

10. The monolithic noise suppression device of claim 8, further comprising:

a first seal to close off an opening formed through a proximal end of said monolithic noise suppression device; and a second seal to close off an opening formed through a distal end of said monolithic noise suppression device.

11. The monolithic noise suppression device of claim 10, wherein said monolithic noise suppression device contains inert gas.

12. The monolithic noise suppression device of claim 1, wherein said monolithic noise suppression device is plastic.

13. A method of manufacturing said monolithic noise suppression device of claim 1 comprising a layered printing process.

14. A noise suppression device for use with a firearm, said device comprising:

a first stage noise suppression device attached to the firearm; and a monolithic, integral baffle housing module attached to said first stage noise suppression device, said monolithic, integral baffle housing module comprising:

an outermost body having an external surface of the noise suppression device;

a plurality of internal chambers; and a core comprising one or more baffles having space between the baffles forming the plurality of internal chambers, wherein the core is seamlessly connected to the internal surface of the body, wherein the housing module includes no joints, seams, or any formerly separate pieces within any of the body, the core, and the one or more baffles.

15. The noise suppression device of claim 14, wherein said first stage noise suppression device extends into a first one of the internal chambers of said monolithic, integral baffle housing module, and wherein a longitudinal axis associated with said first stage noise suppression device aligns with a longitudinal axis associated with said monolithic, integral baffle housing module.

16. The noise suppression device of claim 14, wherein said first stage noise suppression device is metal and said monolithic, integral baffle housing module is plastic.

17. The noise suppression device of claim 14, wherein at least one internal surface associated with the core intersects an internal surface associated with the body such that the point where the surfaces intersect is rounded or filleted.

18. The noise suppression device of claim 14, wherein said monolithic, integral baffle housing module comprises a plurality of linearly aligned baffles, wherein each of the plurality of baffles has formed therethrough an opening centered on a longitudinal axis associated with said monolithic, integral baffle housing module and one or more bleed holes in addition to the opening centered on the longitudinal axis, and wherein the orientation of the one or more bleed holes associated with each of the plurality of baffles is offset relative to the one or more bleed holes associated with an adjacent baffle.

19. The noise suppression device of claim 14, wherein at least one of the plurality of internal chambers contains an ablative material, and wherein an internal surface associated with the at least one internal chamber is textured.

20. The noise suppression device of claim 19, wherein said monolithic, integral baffle housing module contains inert gas.

21. The noise suppression device of claim 14, wherein said monolithic, integral baffle housing module is manufactured in accordance with a layered printing process.

* * * * *